United States Patent [19]

de Jong et al.

[11] 4,200,853

[45] Apr. 29, 1980

[54] TRANSFORMER WITH SINGLE TURN U-SHAPED WINDING

[75] Inventors: Nicolaas J. de Jong; Adrianus C. W. Custers, both of Eindhoven, Netherlands

[73] Assignee: U.S. Philips Corporation, New York, N.Y.

[21] Appl. No.: 901,971

[22] Filed: May 1, 1978

[30] Foreign Application Priority Data

Jun. 6, 1977 [NL] Netherlands ..... 7706192

[51] Int. Cl.[2] ..... H01F 15/10; H01F 27/30

[52] U.S. Cl. ..... 336/192; 336/198; 336/205

[58] Field of Search ..... 336/192, 196, 205, 96, 336/198, 208

[56] References Cited

U.S. PATENT DOCUMENTS

| | | | |
|---|---|---|---|
| 2,972,713 | 2/1961 | Sutton, Jr. | 336/192 X |
| 3,281,744 | 10/1966 | Melanson | 336/208 X |
| 3,689,862 | 9/1972 | Hilgers | 336/198 X |

*Primary Examiner*—Thomas J. Kozma

*Attorney, Agent, or Firm*—Thomas A. Briody; William J. Streeter; Bernard Franzblau

[57] ABSTRACT

A transformer, one winding of which consists of a single turn which is formed by a conductor which is bent to be U-shaped and which is embedded in a body of synthetic material, the two ends of said conductor projecting outside the body and forming connection pins.

3 Claims, 2 Drawing Figures

TRANSFORMER WITH SINGLE TURN U-SHAPED WINDING

The invention relates to a transformer, comprising at least two windings, at least one of which consists of a single turn, said windings being electrically connected to connection pins, each of which consists of an end portion of an elongate conductor which is embedded in a body of synthetic material, so that at least the end portion which serves as the connection pin projects outside the body of synthetic material.

A transformer of this kind can be used, for example, in a power supply system for measuring the input current in order to activate a protection circuit if this input current exceeds a given value. To this end, the primary winding of the transformer, consisting of a single turn, is included in the conductor which carries the input current. A voltage which is capable of controlling the protection circuit then arises across the secondary winding. It frequently occurs that a power supply system of this kind also constitutes the separation between the apparatus being powered (for example, a television receiver) and the a.c. electric supply.

In such cases, the transformer should satisfy given internationally agreed upon safety requirements. To this end, the shortest creepage path and the smallest insulation thickness between the primary and the secondary winding must exceed given values. It is more difficult and more expensive to satisfy these requirements as the dimensions of the transformer are smaller.

The invention has for its object to provide a transformer of the described kind which is small and inexpensive and in which the creepage path and the insulation thickness between the primary winding and the secondary winding are comparatively large.

To this end, the transformer in accordance with the invention is characterized in that at least one of the elongate conductors is bent to be U-shaped and forms the winding consisting of a single turn, said conductor being embedded in a first body of synthetic material, the two ends of this conductor projecting outside the first body of synthetic material and serving as connection pins for this winding. The first body of synthetic material is accommodated in a space recessed in a second body of synthetic material which supports at least one further winding of the transformer and also the connection pins of this further winding.

As a result of this construction, it is no longer necessary to connect the primary winding to the connection pins (for example, by soldering), so that it is not necessary to protect the location where such a connection is realized by an insulating shield at a later stage.

Figure 1:
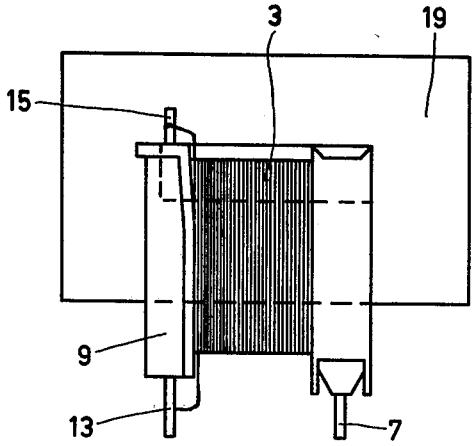
Figure 2:
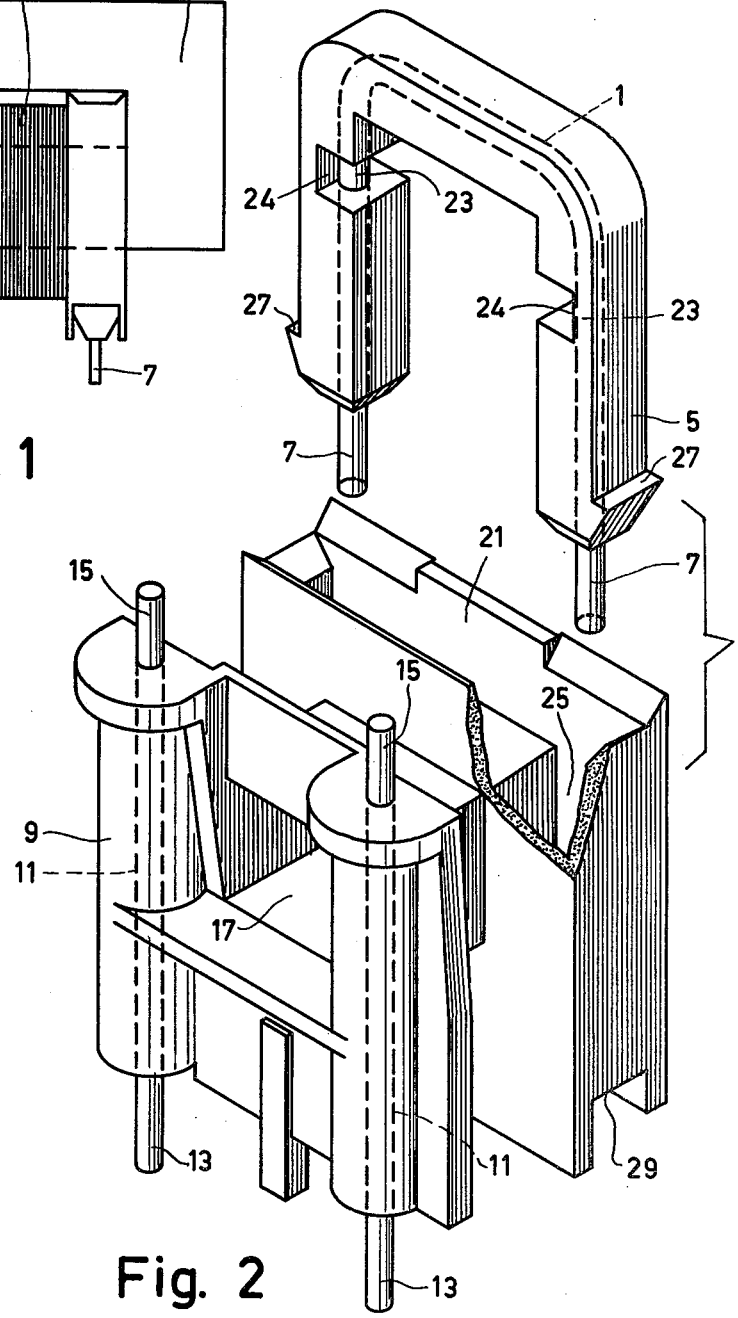

The invention will be described in detail hereinafter with reference to the accompanying diagrammatic drawing, in which:

FIG. 1 is a side elevation of an embodiment of a transformer in accordance with the invention and FIG. 2 is a perspective view, on an enlarged scale, of some parts of the transformer shown in FIG. 1.

The transformer comprises a primary winding 1 and a secondary winding 3. The winding 1 is formed by a single turn in the form of an elongate conductor which is bent to be U-shaped and which is embedded in a first body 5 of a synthetic material which leaves both ends of the conductor, serving as connection pins 7, bare.

The secondary winding 3 consists of a number of turns of copper wire which are provided on a second body 9 of synthetic material in which two elongate conductors 11 are embedded so that both ends of each of the conductors project outside the body 9. The lower ends constitute connection pins 13, and the upper ends 15 serve for connecting the ends of the secondary winding 3 to the conductors 11.

In the second body 9 of synthetic material, a cavity 17 is recessed in which a ferromagnetic core 19 is arranged. Furthermore, a space 21 is recessed in the body 9 which serves to accommodate the first body 5 of synthetic material with the primary winding 1. As appears from FIG. 2, the body 5 not only leaves the connection pins 7 bare, but also two further portions 23 of the conductor which serves as the primary winding 1. This is due to the fact that, during the formation of the body 5 of synthetic material in a mould, the turn 1 is not only clamped at the area of the connection pins 7, but also at the area of the portions 23, so that openings 24 are formed. This is desirable in order to prevent the turn 1 from being pushed aside by the liquid synthetic material injected into the mould, so that it would be eccentrically arranged in the body 5, with the result that it would not be covered in all places by a layer of synthetic material of optimum thickness. The shifting of the turn 1 during injection moulding can also be prevented by filling the mould in a slower manner, but this takes more time and may, therefore, have a cost increasing effect.

In order to prevent a dangerous condition due to the bare portions 23 of the primary winding 1, the space 21 comprises two tubular portions 25 in which the bare portions are situated. As a result, a long creepage path exists between these bare portions and the core 19 and the secondary winding 3. Alternatively, the bare portions 23 can be covered after the formation of the body 5, for example, by the provision and glueing down of parts which will fill or cover the openings 24.

The legs of the U-shaped conductor which constitutes the primary winding 1, and also the parts of the first body 5 of synthetic material which surround these legs, are constructed to be slightly resilient. On the free ends of these parts, hooks 27 are formed which snap behind faces 29 when the body 5 is inserted into the space 21, the first body of synthetic material thus being anchored in the second body.

Instead of consisting of a large number of turns, the secondary winding 3 can alternatively consist of a single turn. In that case it can be constructed in the same manner as the primary winding 1. Alternatively, the number of windings may also be larger than two.

What is claimed is:

1. A transformer comprising first and second windings, said first winding comprising a single turn in the form of a U-shaped elongate conductor embedded in a first body of synthetic material and having two ends of the conductor projecting outside said first body of synthetic material to serve as connection pins for said first winding, the second winding being electrically connected to connection pins comprising an elongate conductor embedded in a second body of synthetic material and having end portions of the elongate conductor projecting outside the second body of synthetic material to serve as said connection pins, and the first body of synthetic material being accommodated in a space recessed in the second body of synthetic material which supports at least the second winding of the transformer and also the connection pins of said second winding.

2. A transformer as claimed in claim 1, wherein the first body of synthetic material not only leaves the portions which serve as connection pins bare, but also at least one further portion of the U-shaped conductor, the space recessed in the second body of synthetic material comprising one or more tubular portions in which these further bare portions are situated.

3. A transformer as claimed in claim 2, wherein the first body of synthetic material is anchored in the second body of synthetic material by means of resiliently movable hooks.

* * * * *